United States Patent [19]

Mortin

[11] 4,327,565

[45] May 4, 1982

[54] COMBINATION LOCK MECHANISM

[76] Inventor: Harold S. Mortin, 2014 Billy Glen, Escondido, Calif. 92025

[21] Appl. No.: 111,926

[22] Filed: Jan. 14, 1980

[51] Int. Cl.[3] ..... E05B 37/08

[52] U.S. Cl. ..... 70/303 R; 70/321; 70/332

[58] Field of Search ..... 70/320, 321, 332, 333 R, 70/302, 303 R

[56] References Cited

U.S. PATENT DOCUMENTS

| | | | |
|---|---|---|---|
| 2,026,932 | 1/1936 | Cisor | 70/332 |
| 2,881,612 | 4/1959 | Smith | 70/333 R |
| 3,481,167 | 12/1969 | Berner | 70/303 R |

FOREIGN PATENT DOCUMENTS

| | | | |
|---|---|---|---|
| 553775 | 6/1932 | Fed. Rep. of Germany | 70/332 |

*Primary Examiner*—Robert L. Wolfe

*Attorney, Agent, or Firm*—Bruno J. Verbeck; Michael L. Slonecker

[57] ABSTRACT

An improved combination lock mechanism including a dial adapted for removable securement thereto. Mechanically connecting a conventional wheel pack and drive cam combination to a lock cam is a locking lever pivotally secured at a point intermediate the opposite ends thereof to said lock cam, said lever having a first end adapted for engagement by said drive cam and wheel pack and a second end conforming to at least a portion of the peripheral geometry of said wheel pack. Finally, there is included a relock plate and means for biasing said relock plate against lock bolt connective members. Fence members are formed on said relock plate and spaced apart a distance slightly less than the distance between the ends of said connective members when said connective members are in an extended position. Thus, the urging of said relock plate against said extended members upraises said fence members to a position proximate the ends of said extended connective members whereby to inhibit the retraction of the locking bolts.

14 Claims, 6 Drawing Figures

COMBINATION LOCK MECHANISM

BACKGROUND OF THE INVENTION

The present invention relates to the field of security locks, and more particularly to an improved combination lock mechanism.

In this particular art it is old and well know to provide a combination lock mechanism including a dial, a rotatable spindle cooperating with said dial, a drive cam rigidly secured to the rearmost end of said spindle and a plurality of tumbler wheels surmounted upon said spindle proximate the drive cam and cooperating therewith. Gates are provided upon the drive cam and tumbler wheels such that manipulation of the dial in accordance with a predetermined numerical sequence aligns said gates and permits the accommodation therein of a spring-biased locking lever. Said locking lever is pivotally secured at one end thereof to a lock cam surmounting the spindle proximate the tumbler wheel assembly. A plurality of slots are disposed through the lock cam which slidably accommodate pins or the like secured to a multiplicity of locking bolt connective members. Thus, as the dial and spindle are rotated to align the drive cam and tumbler gates, the locking lever is urged into said gates and thereby engaged. The continued rotation of the dial and spindle causes the lock cam, by virtue of its securement to the locking lever, to rotate and displace the locking bolts from an extended position to a retracted position, thereby permitting the removal of the vault door and enabling access into the vault interior.

In order to minimize the breach of vault security, it is old in the art to provide a lock mechanism having a removable dial cooperating with the spindle. Briefly stated, this is conventionally accomplished by providing the spindle with an enlarged cross-sectional end face including a multiplicity of conformable recesses therethrough, a first recess aligned substantially along the lateral axis of the spindle and a second recess positioned proximate the periphery of said end face. Formed upon the back face of the dial are a multiplicity of extended pin members which may be conformably accommodated within the recesses, thereby enabling rotation of the spindle.

While the aforesaid manner of forming a removable dial provides for the positive engagement of the spindle by the dial, a drawback associated with such a configuration resides in the fact that said first recess provides a convenient guide for an individual intent upon breaching the security of the vault with a drill or punch. Once able to gain access through the spindle into the interior of the door and vault, it is a simple matter to punch off the combination lock mechanism from the threaded end of the spindle and manipulate the lock cam whereby to retract the lock bolts.

A still further drawback to such dials resides in the fact that the prior art devices are not provided with any means whereby to firmly retain the dial in place upon the spindle. Thus, an individual using the vault must constantly cope with the problem of having the dial fall off when the door is rotated to a vertical position.

In the prior art devices, the locking lever generally comprises an arcuate member aligned on its vertical edge and pivotally secured at one end thereof to the lock cam, the lever substantially conforming in geometry to the tumbler wheel assembly and arcing slightly in excess of 90° about the periphery of said assembly. An inwardly directed nose and fence portion are formed at the opposite end of the locking lever, the nose and fence portions respectively engaging the gates provided upon the drive cam and tumbler assembly. A lock post secured to the vault door housing abuts the locking lever proximate said fence portion and restricts rotation of the locking lever absent the engagement of said lever within the gates.

A drawback associated with prior art locking lever designs resides in the fact that, once the security of the vault door interior has been breached, the locking lever may be manipulated outwardly away from the tumbler wheel assembly a distance sufficient to permit the nose and fence portions thereof to by-pass the lock post. Once by-passed, the lock post no longer inhibits lock cam rotation and the cam may be manipulated to retract the locking bolts.

Finally, the prior art has failed to teach or suggest any means whereby to prevent or inhibit the retraction of the locking bolts should the lock mechanism components be forcibly removed from their positions about the spindle.

Thus, it is an object of the present invention to provide an improved security vault door which retains a removable dial in place upon the end face of a spindle irrespective of the orientation of said door.

A still further object is to provide an improved security vault door which includes a locking lever preventing manipulation thereof whereby to by-pass the lock post.

Yet another object is to provide means for retaining said locking bolts in an extended and locked position should the lock mechanism components be forced from their positions surmounting the spindle.

The aforementioned several objects and others of the present invention will be readily appreciated from the following detailed description of the preferred embodiment taken in conjunction with the accompanying drawings.

SUMMARY OF THE INVENTION

The present invention relates to an improved security vault door combination lock mechanism including new and improved mechanical elements cooperating with others known to the art whereby to provide enhanced protection for the contents of a vault enclosure. Briefly stated, these new elements include an improved removable dial cooperating with a rotatable spindle. Means are provided for retaining the dial against the spindle whereby to prevent the dial from inadvertently separating therefrom should the door be rotated to a vertical position.

An improved locking lever, mechanically connecting a conventional wheel pack and drive cam to a lock cam, is pivotally secured, intermediate the opposite ends thereof, to the lock cam. The locking lever includes an arcuate extension conforming to at least a portion of the peripheral geometry of the wheel pack whereby to prevent the opposite end of said locking lever from being manipulated a distance sufficient to by-pass a lock lever post inhibiting lock cam rotation.

Finally, relock means, in the form of a spring and relock plate are provided to inhibit locking bolt retraction in the event the combination lock components are forcibly removed from their position surmounting the spindle. Fence members are included upon said relock plate spaced apart a distance slightly less than the distance between the ends of locking bolt connective members when said connective members are in a fully extended position.

DETAILED DESCRIPTION OF THE DRAWINGS

DETAILED DESCRIPTION OF THE PREFERRED EMBODIMENT

Figure 1:
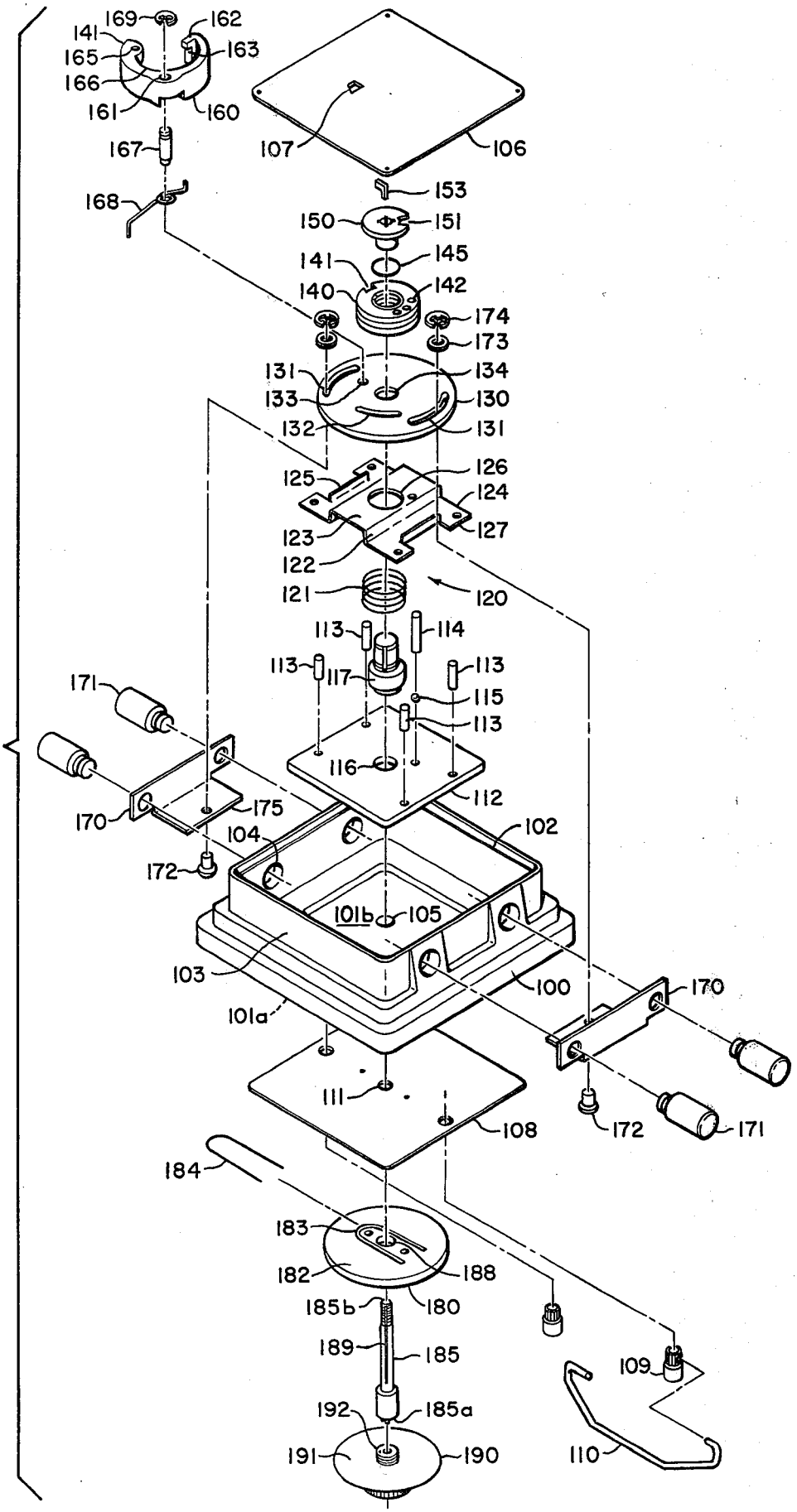
FIG. 1 is an exploded, perspective view of a security vault door constructed in accordance with the present invention.

For a more complete understanding of the present invention reference is now made to the accompanying several figures wherein like reference numerals refer to like parts throughout the several views. As shown in FIG. 1, the present invention includes a substantially hollow door housing 100 having a front surface 101*a*, a sidewall 103 structure substantially conforming to the shape of a vault (not shown) entrance whereupon it rests, and a multiplicity of bores 104 through sidewalls 103 which serve as guides for a plurality of locking bolts 171. A removable cover plate 106 rests within a rib 102 formed upon sidewalls 103 and is secured thereto by any conventional means, such as screws, whereby to close the rear of housing 100. An aperture 107 is provided through plate 106 to permit the insertion of a key (not shown) so that the lock combination can be altered.

A faceplate 108 is provided and secured to the front surface 101*a* of housing 100 by means of lugs 109, the lugs accommodating a handle member 110 to permit the removal of housing 100 from a vault enclosure. Of course, it will be understood that housing 100 may additionally be hinged to a vault enclosure by any conventional means.

Figure 4:
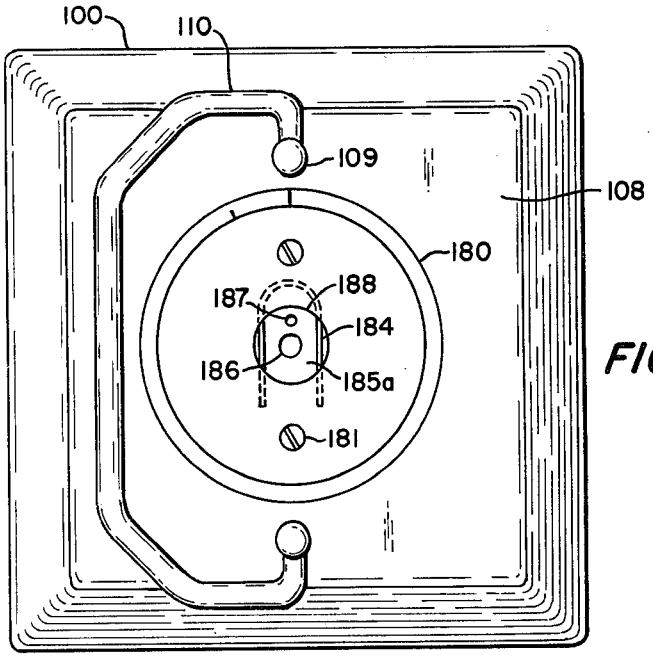
FIG. 4 is a plan view of the front of the security vault door.

A dial ring 180 (see also FIG. 4), appropriately marked at its periphery to provide a reference point for manipulating a dial 190, is secured to the faceplate 108 by means of screws 181 or the like. The backface 182 of the dial ring 180 is provided with a conforming recess 183 securely accommodating a dial retainer spring 184. Ring 180 includes an aperture 188 therethrough coincident with apertures 111 and 105 through faceplate 108 and front surface 101*a*, respectively.

Dial retainer spring 184 has a generally U-shaped configuration and includes substantially parallel flexible spring members spaced apart a distance less than the diameter of aperture 188, the reason for such spacing being readily apparent from the discussion which follows.

Figure 5:
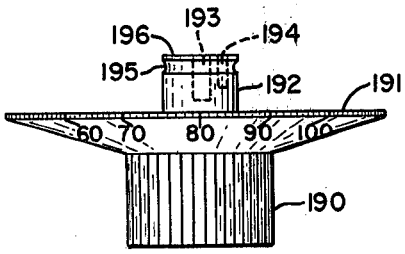
FIG. 5 is a side-view of the removable dial.

A dial 190 (see also FIG. 5), conventionally marked and raised to facilitate manipulation thereof, is provided with a backface 191 disposed over a major portion of dial ring 180. A cylindrical extension 192 is formed on backface 191 and includes a circumferential annular groove 195 proximate the end face 196 of extension 192. A plurality of recesses 193 and 194, or the like, are laterally disposed through end face 196 and conformably accommodate a plurality of case hardened pin members 186 and 187 (FIG. 4), or the like, laterally extending from the endface 185*a* of spindle 185. It will be appreciated that as the cylindrical extension 192 is directed through aperture 188, dial retainer spring 184 is caused to engage the annular groove 195 and thereby retain dial 190 in place. After use of the security vault is completed, dial 190 may be conveniently removed and transported for storage to another location, thereby providing an enhanced measure of protection for the contents of the vault.

The invention further includes a case hardened plate 112 secured by welding or the like to back surface 101*b* of housing 100. A plurality of guide rods 113 are rigidly secured in a spaced apart manner perpendicular to plate 112 and project rearwardly into the interior of housing 100. An enlarged bore 116 is provided through plate 112, bore 116 being substantially coincident with aperature 105. A lock post 114 is perpendicularly secured to plate 112, a rotatable ball bearing 115 further being included at the point of securement whereby to prevent an individual from dislodging lock post 114 by drilling through housing 100. A hollow boss or center post 117 is secured at one end thereof within aperature 116 and projects rearwardly from plate 112.

Spindle 185 is disposed through center post 117 and is threaded along a substantial portion of its rearmost end 185*b*, whereby to receive an internally threaded conformable bore 152 (FIG. 2) forwardly projecting from a drive cam 150 and integral therewith. The drive cam 150 is secured to spindle 185 by inserting a suitable spline key 153 into a radial groove (not shown) in the bore 152 of the drive cam 150 which is aligned radially with a longitudinal spline 189 included along spindle 185, thus interlocking these components to prevent relative rotation.

Disposed subjacent drive cam 150 and cooperating therewith is a wheel pack 140 comprising a stack or array of a plurality of conventional tumbler wheels. Wheel pack 140 is surmounted to freely rotate about the rearwadly projecting portion of center post 117 and is retained in a spaced apart relationship from drive cam 150 by means of a spirolox washer 145. Each tumbler wheel included in wheel pack 140 is of a conventional type and designed to have their combination changed by inserting a key (not shown) into a slot 142 (see FIG. 3) disposed through each tumbler wheel. Formed upon the periphery of each tumbler wheel and drive cam 150 are gates 141 and 151, respectively.

The manner in which wheel pack 140 operates is well known and understood by those skilled in the art. Inasmuch as the wheel pack 140 is of conventional design, further discussion as to its manner of operation is deemed unnecessary. As an example of a presently available wheel pack suitable for inclusion within the invention, such as would include the wheel pack manufactured by Sergeant and Greenleaf, Inc. of Nicholasville, Ky., and known to the trade as a 6730 Group 2 key change combinationwheel pack.

Figure 2:
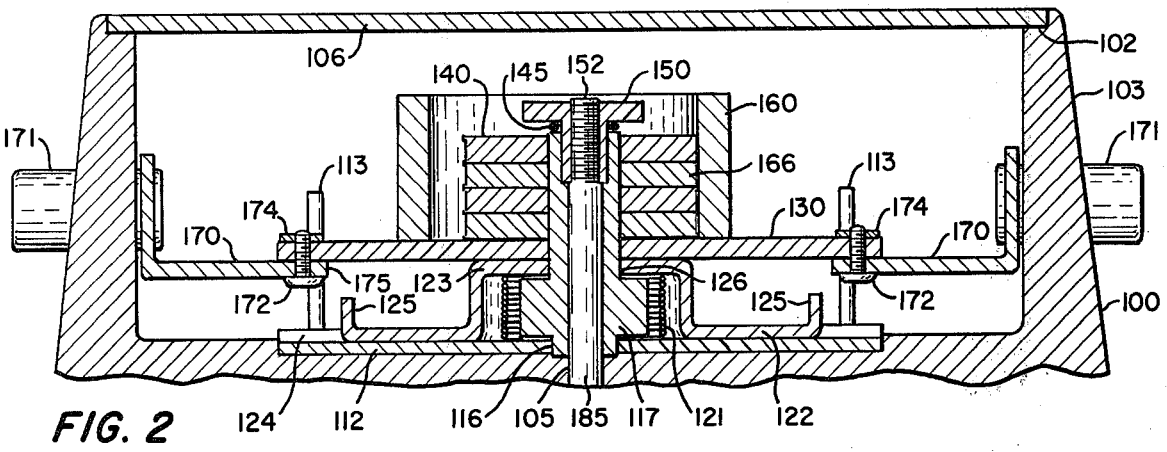
FIG. 2 is a partial side-view, in section, of the preferred embodiment shown in FIG. 1.
Figure 3:
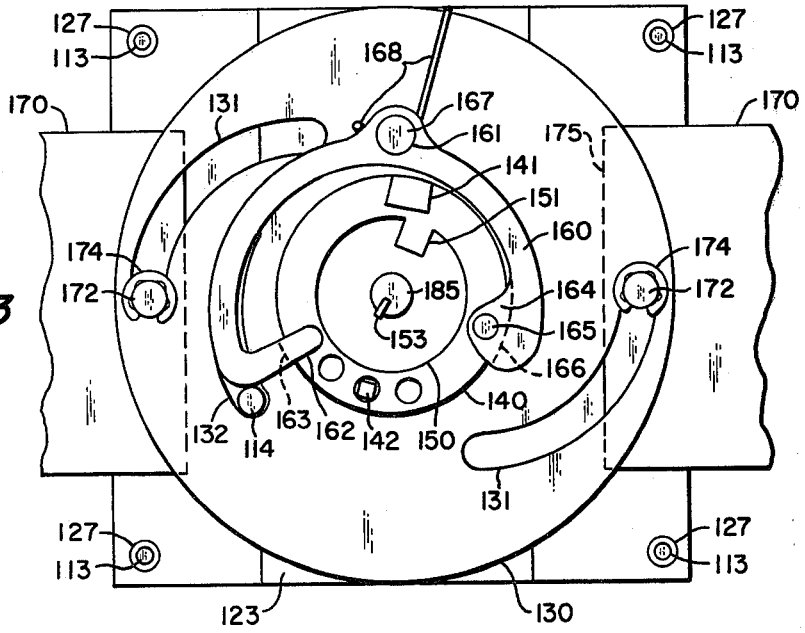
FIG. 3 is a partial plan view of the interior of the security vault door shown in FIGS. 1 and 2.

As best shown by reference to FIGS. 1,2, and 3, the invention further includes a rotatable lock cam 130 surmounted upon center post 117 subjacent wheel pack 150. A plurality of helical slots 131 are disposed through lock cam 130 and serve as guide paths for pin members 172. A slot 132 is provided through cam 130 to permit partial rotation of cam 130 about lock post 114. An aperture 133 is additionally provided whereby to accommodate and secure threto a lock lever post 167.

Pin members 172, disposed through slots 131 and slidably secured to lock cam 130 by washer 173 and retainer clip 174, are rigidly secured to lock bolt connective members 170 adapted at one end thereof to receive lock bolts 171. Each member has an endface 175 which is withdrawn towards the interior of housing 100 by virtue of the cooperation of pin members 172 with slots 131.

A locking lever 160 is included for mechanically connecting wheel pack 140 and drive cam 150 to lock cam 130. Beneficially, locking lever 160 comprises an arcuate member pivotally secured intermediate the opposite ends thereof to lock cam 130 and having an interior sidewall 166 substantially conforming to the peripheral geometry of wheel pack 140. Pivotal securement is provided by including a bore 161 through lever 160 whereby lever 160 may be surmounted upon a locking lever post 167 rigidly secured to lock cam 130. A clip 169 engaging post 167 is provided to secure lever 160 thereto. Formed upon one end of lever 160 are an inwardly directed nose 162 and fence 163 of a size sufficient to translate into, and be engaged by, gates 151 and 141, repectively. A spring 168 is further included for biasing nose 162 and fence 163 against the cam 150 and wheel pack 140 assembly.

The opposite end of lever 160 includes an inwardly directed flange member 164 disposed over wheel pack 140 and including a bore 165 therethrough which serves as a guide slot for a combination change key. It will be appreciated that when dial 190 is positioned to permit changing the combination for the lock mechanism, aperture 107, bore 165, and slot 142 will be coincident. Thus, bore 165 provides a means for ensuring that the combination change key is maintained in positive and proper alignment with slots 142.

Relock means 120, interposed between plate 112 and lock cam 130, are finally included for inhibiting lock bolt retraction should the lock mechanism components be forcibly removed from their positions surmounting spindle 185. As best shown in FIGS. 1 and 2, said relock means 120 comprises a relock plate 122 and spring 121 for urging plate 122 rearwardly against lock cam 130.

Lock plate 122 includes a raised step 123 accommodating thereunder spring 121 and engaging a major portion of lock cam 130 to provide support thereof. An enlarged bore 126 is disposed through step 123 whereby to permit surmounting of lock plate 122 about center post 117. Leg members 124 are provided to form a base for said lock plate 122 and extend from step 123 a distance sufficient to deploy the ends of said leg members 124 beneath the lock bolt connective members 170. A multiplicity of bores 127 are disposed through said leg members 124 for the slidable accommodation of guide rods 113, guide rods 113 serving to ensure that relock plate 122 is properly oriented during upraisement. Formed upon legs 124 are a plurality of fence members 125 spaced apart a distance slightly less than the distance between the end faces 175 of lock bolt connective members 170 when members 170 are in a fully extended position. It will be appreciated that in the event the lock assembly is forcibly removed from the end of spindle 185, spring 121 will rearwardly urge relock plate 122 a distance sufficient to force leg members 124 against the lower surface of connective members 170. In this manner fences 125 will be upraised to a position proximate the endfaces 175 and will prevent the manual retraction of bolts 171.

Having described the various components comprising the invention, it is to be appreciated that the invention operates in the following manner: A suitably marked dial 190 is first inserted through aperture 188 and caused to engage pin members 186 and 187 laterally entending from spindle 185. Retainer spring 184 is initially displaced during insertion and thereafter engages the peripheral groove 195 to firmly retain dial 190 in place. As dial 190 and spindle 185 are rotated, drive cam 150 is caused to rotate thereby engaging and rotating the plurality of tumblers comprising wheel pack 140. Following manipulation of dial 190 in a manner corresponding to the numerical sequence comprising the combination for the lock mechanism, gates 141 and 151 will be caused to axially align and the nose 162 and fence 163 portions of the locking lever 160 urged therein by spring 168, thus by-passing lock post 114. At such time as said portions of locking lever are engaged within said gates, continued rotation of dial 190 causes lock cam 130 to rotate by virtue of its securement to locking lever 160. Rotation of lock cam 130 in turn causes the engagement of pins 172 and results in the retraction of bolts 171 as pins 172 are caused to follow the path provided by the helical slots 131. Conversely, reversed rotation of dial 190 will displace bolts 171 to an extended position and secure housing 100 to the vault enclosure.

Of primary importance in describing the operation of the invention are the advantages realized by the improved locking lever 160 herebefore described. With reference to FIG. 3, spring 168 urges the nose 162 and fence 163 of locking lever 160 against the periphery of drive cam 150 and wheel pack 140. Until such time as gates 141 and 151 are axially aligned to permit the engagement therein of nose 162 and fence 163, lock post 114 prevents the rotation of locking lever 160 and lock cam 130. Once lever 160 is engaged in the gates, lock post 114 is mechanically by-passed and cam 130 may be rotated to extend and retract bolts 171.

In the prior art devices using a locking lever of approximately 90° arcuate extension and hinged at one end thereof, once the security of the vault interior is breached the lock lever may be manipulated outwardly from wheel pack 140 a distance sufficient to permit the nose and fence portions thereof to by-pass the lock post. Once by-passed, the lock post no longer inhibits lock cam rotation and the lock cam may be manipulated to retract the locking bolts. By providing an arcuate extension conforming to at least a postion of the peripheral geometry wheel pack assembly, this manner of by-passing the lock post is precluded and vault security enhanced.

Finally, it will be appreciated that relock plate 122 provides a positive means, hitherto unknown to the art, of preventing bolt 171 retraction in the event the combination lock components are removed from the rearmost end of spindle 185.

While a preferred embodiment of the invention has been described herein, it is to be appreciated that various changes, modifications, and rearrangements can be made without departing from the scope and essense of the invention as defined in the appended claims.

Figure 6:
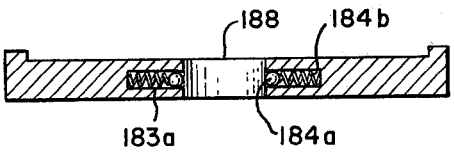
FIG. 6 is a side-view, in section of an alternate embodiment for dial securement means.

For example, FIG. 6 is an alternate embodiment of flexible dial securement means which comprises a dial ring 180 having chambers **183*a* communicating with aperature 188 and accommodating bearing 184*a* and spring 184*b* members therein. At least a portion of bearing members 184*a* extends into aperature 188 whereby to engage and secure a dial 190 (FIG. 5) inserted through aperature 188**.

Therefore, it is intended that the present specification and claims not be interpreted in a limiting sense and that obvious variants thereof are comprehended to be within the essense and scope of the invention.

What is claimed is:

1. An improved combination lock mechanism, comprising:

(a) a substantially hollow door housing;

(b) a rotatable spindle directed into the interior of said housing, said spindle including at least one laterally extended member integrally formed upon one end thereof;

(c) a dial including at least one recess partially disposed therethrough engaging said extended member whereby to rotate said spindle;

(d) means for detachably securing said dial to said spindle;

(e) a drive cam, having a peripheral gate, secured to the opposite end of said spindle within said housing;

(f) a plurality of tumbler wheels, each of said wheels including a peripheral gate, surmounted upon said spindle proximate said drive cam and cooperating therewith;

(g) a lock cam surmounted upon said spindle proximate said tumbler wheels, said lock cam including a plurality of helical slots disposed therethrough;

(h) a locking lever pivotally secured at a point intermediate the opposite ends thereof to said lock cam, said lever including a first end adapted for engagement within said peripheral gates and a second end conforming to at least a portion of the peripheral geometry of said tumbler wheels;

(i) means for urging said first end of said locking lever into said peripheral gates;

(j) a plurality of locking bolt connective members;

(k) means, disposed through said helical slots, for slidably securing said locking bolt connective members to said lock cam; and (l) means for relocking said connective members in a fully extended position whereby to inhibit locking bolt retraction.

2. An apparatus as defined in claim 1, wherein said dial further includes a cylindrical extension formed upon the backface of said dial, said extension including an annular groove thereabout for engagement by said dial securement means.

3. An apparatus as defined in claim 2 wherein said dial securement-means comprises a flexible member secured to said housing.

4. An apparatus as defined in claim 1, wherein said relock means comprises:

(a) a plate member surmounting said spindle proximate said lock cam, said plate member including leg members extending from said spindle a distance sufficient to deploy the ends thereof subjacent said locking bolt connective members, said plate member further including a plurality of fence members, formed upon said leg members and spaced apart a distance less than the fully extended distance between the endfaces of said locking bolt connective members; and (b) means for biasing said plate member towards said locking bolt connective members.

5. An apparatus as defined in claim 4 wherein said biasing means is a spring.

6. An apparatus as defined in claim 5 wherein said plate member further includes a raised step accommodating said spring subjacent thereof.

7. An apparatus as defined in claim 1 wherein said tumbler wheels include combination change key slots therethrough and said second end of said locking lever includes a flange member deployed over said tumbler wheels, said flange member having a bore therethrough coincident with said combination change key slots.

8. In a combinaton lock mechanism including a substantially hollow door housing; a rotatable spindle directed into the interior of said housing; a dial engaging said spindle for rotation thereof; a drive cam, having a peripheral gates, secured to the end of said spindle within said housing; a plurality of tumbler wheels, each of said wheels including a peripheral gate, surmounted upon said spindle proximate said drive cam and cooperating therewith; and a lock cam surmounted upon said spindle proximate said tumbler wheels; the improvement which comprises a locking lever pivotally secured at a point intermediate the opposite ends thereof to said lock cam, said lever including a first end adapted for engagement within said peripheral gates and a second end conforming to at least a portion of the peripheral geometry of said tumbler wheels.

9. An Apparatus as defined in claim 8 wherein said tumbler wheels include combination change keys slots therethrough and said second end of said locking lever includes a flange member deployed over said tumbler wheels, said flange member having a bore therethrough coincident with said combination change key slots.

10. In a combination lock mechanism including a substantially hollow door housing; a rotatable spindle directed into the interior of said housing; a drive cam, having a peripheral gate, secured to the opposite end of said spindle within said housing; a plurality of tumbler wheels, each of said wheels including a peripheral gate, surmounted upon said spindle proximate said drive cam and cooperating therewith; a lock cam surmounted upon said spindle proximate said tumbler wheels; a locking lever pivotally secured to said lock cam and adapted for engagement within said peripheral gates; and a plurality of locking bolt connective members adapted to cooperate with said locking cam whereby said locking bolt connective members may be extended or retracted; the improvement which comprises a plate member surmounting sad spindle proximate said lock cam, said plate member including leg members extending from said spindle a distance sufficient to deploy the ends thereof subjacent said locking bolt connective members, said plate members further including a plurality of fence members formed upon said leg members and spaced apart a distance less than the fully extended distance between the endfaces of said locking bolt connective members, and means for biasing said plate member towards said locking bolt connective members.

11. An apparatus as defined in claim 10 wherein said biasing means is a spring.

12. An apparatus as defined in claim 11 wherein said plate member further includes a raised step accommodating said spring subjacent thereof.

13. A combination lock mechanism, comprising:

(a) a dial member having a substantially cylindrical member projecting therefrom, said cylindrical member including an annular groove thereabout;

(b) a housing member having an aperture adapted to receive said cylindrical members; and (c) flexible retainer means for detachably securing said dial member to said housing member, said retainer means comprising a spring-like member projecting across said aperture a distance sufficient to urge a portion thereof into a position of engagement with said annular groove, said spring-like member being sufficiently flexible so that said portion is urged into said position of engagement in response to the insertion of said cylindrical member into said aperture, said spring-like member, because of said flexibility, being operable, in response to the removal of said cylindrical member from said aperture, to disengage said portion from said position of engagement.

14. A combination lock mechanism as set forth in claim 14, further comprising a rotatable spindle having a pin member projecting from one end thereof and communicating with said aperture, said cylindrical member further including a recess partially disposed therethrough conformably accommodating said pin member.

* * * * *

UNITED STATES PATENT AND TRADEMARK OFFICE

CERTIFICATE OF CORRECTION

PATENT NO. : 4,327,565
DATED : May 4, 1982
INVENTOR(S) : HAROLD S. MORTIN

It is certified that error appears in the above-identified patent and that said Letters Patent are hereby corrected as shown below:

In Claim 14, line 2, delete "14" and substitute --13--.

Signed and Sealed this

*Twenty-ninth* Day of *June 1982*

[SEAL]

*Attest:*

GERALD J. MOSSINGHOFF

*Attesting Officer*

*Commissioner of Patents and Trademarks*